US005494295A

United States Patent [19]

Potter et al.

[11] Patent Number: 5,494,295

[45] Date of Patent: Feb. 27, 1996

[54] BANKING TYPE WAGERING GAME

[76] Inventors: Bruce H. Potter; Deborah J. Potter, both of P.O. Box 305, Surfside, Calif. 90743

[21] Appl. No.: 369,099

[22] Filed: Jan. 5, 1995

[51] Int. Cl.[6] ..... A63F 1/00

[52] U.S. Cl. ..... 273/292

[58] Field of Search ..... 273/292, 309, 273/274

[56] References Cited

U.S. PATENT DOCUMENTS

| | | | |
|---|---|---|---|
| 5,154,429 | 10/1992 | La Vasseur | 273/292 |
| 5,265,882 | 11/1993 | Malek | 273/292 |
| 5,288,082 | 2/1994 | Marquez | 273/292 |
| 5,294,128 | 3/1994 | Marquez | 273/292 |

OTHER PUBLICATIONS

"*Scarne's Encyclopedia of Games,*" J. Scarne, Chapter 2, pp. 6–14.

*Primary Examiner*—Benjamin H. Layno

[57] ABSTRACT

Methods of playing banking type wagering games wherein a plurality of different sets of predetermined hand ranking rules are utilized within a single hand. A player is provided with an initial partial hand and decides from that partial hand which set(s) of predetermined hand ranking rules to play the hand against. The player may play the hand against any number of the hand ranking rules. After the player has decided which set(s) of predetermined hand ranking rules to play against, the player may receive additional cards to complete their hand. The player's goal is either to achieve one or more predetermined winning hand combinations, or to beat one or more of a plurality of bank hands, with each bank hand being played by a different set of predetermined hand ranking rules. The layout of the table could include boxes or lines or areas which the player could utilize to indicate which banker hand(s) or set(s) of predetermined hand ranking rules they chose to play their hand against.

19 Claims, 2 Drawing Sheets

BANKING TYPE WAGERING GAME

BACKGROUND—FIELD OF INVENTION

The present invention pertains to the field of games, more specifically banking type games suitable for play in casinos for money wagers.

BACKGROUND—DESCRIPTION OF PRIOR ART

Games are considered educational, exciting, stimulating, encourage human communication, and test the strategic abilities of an individual. When the added factor of wagering is included in a game, all of the elements mentioned above are greatly heightened. The two different methods of operation for wagering games are poker type and banking type. Poker type wagering games involve at least two players playing against each other. Banking type wagering games involve at least one player playing against a dealer who is an employee of the casino, or against one "bank" player who is not associated with the casino.

Wagering games are played in casino's by a wide variety of players, from beginner to skilled professional. Players enjoy variable combinations of relatively simple, fast-moving wagering games. Many poker type wagering games have an added level of excitement wherein the players utilize multiple game strategies within a single game. For example, many poker games are played high/low split. The object of a high/low split poker game is to make a better poker hand or a better lowball hand than any other player. The player with the best poker hand will win half of the total amount wagered, i.e. the "pot" and the player with the best lowball hand will win the other half of the pot. Games with multiple game strategies have become increasingly popular in casinos, and are in large demand. This demand, however, has only been met by poker type wagering games, but not by banking type wagering games. The field of banking type wagering games utilizes a wider variety of game strategies than the field of poker type wagering games, but has not yet found a method to play multiple game strategies in a single game.

Banking type wagering games can employ cards, tiles, dice, dominos, etcetera, and are played against a dealer or "bank" player. In some banking type wagering games, there is no dealer hand to play against. When there is no dealer hand, the object is to reach a certain winning combination. In other banking type wagering games, the goal of each player is to beat the dealer's or "bank" player's hand. In blackjack, for example, cards are employed, and each card is assigned a predetermined point value. Each player's hand that is closer to twenty-one points than the dealer's hand, without going over twenty-one points, will be paid an amount equal to their original wager.

One banking type wagering game, Multiple Action Blackjack, protected under U.S. Pat. No. 5,257,789 to Le Vasseur (1993) allows each player to play their hand against any number of a plurality of dealer hands. This concept increases the excitement, speed, and revenue of a game, because the player has the opportunity to play against more than one dealer hand, per round of play. In this game, however, there is only one predetermined strategy. This method of play still limits variety, mental stimulation, and the test of strategic abilities that is provided by wagering games. A single banking type wagering game that could offer multiple game strategies would broaden the field of banking type wagering games, and would be welcomed by both casinos and players.

OBJECTS AND ADVANTAGES

Currently, within each banking type wagering game, only one single set of hand ranking rules can be offered. It is an object of the present invention to provide a method whereby a plurality of hand ranking rules can be utilized within a single banking type wagering game.

It is an advantage of the present invention that players are provided with an alternative set of hand ranking rules to play against. This provides a player with a selection of, essentially, multiple different games, within a single game. This concept of utililizing multiple different hand ranking rules within a single game provides a higher level of strategy than has ever been achieved within a banking type wagering game.

Still further objects and advantages will become apparent from a consideration of the ensuing detailed description.

REFERENCE NUMERALS

Figure 1:
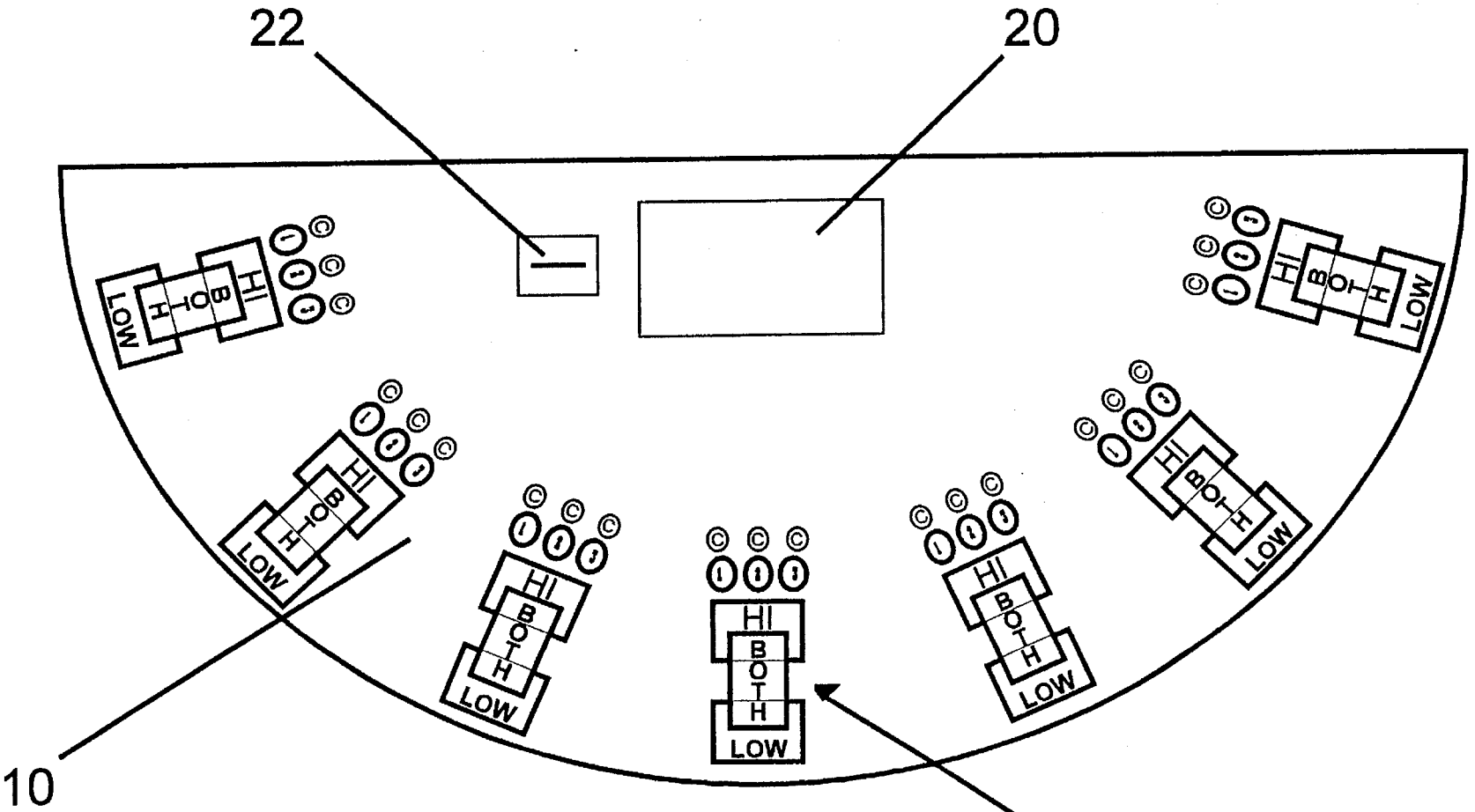
FIG. 1 shows the top view of a useful playing surface for one embodiment of the present invention.

10 playing surface
12 player station
14 wager area
16 house collection area
18 decision area
20 chip tray opening
22 house collection slot
24 supplemental or "backline" wager area

SUMMARY

The present invention is novel in the field of banking type wagering games, wherein a player is given the opportunity to play a hand using game pieces, such as cards, tiles, dice, dominoes, etcetera, against a plurality of separate different hand ranking rules. The preferred embodiment utilizes playing cards and standard poker values that are known to skilled players, and easily learned by beginners. In the preferred embodiment the "bank" receives two separate hands, one that utilizes the hand values of standard poker and one that utilizes the hand values of lowball poker. Once each player has received four of their five cards, each player decides which of the dealers hands to play against, with the option of playing against both, then each player receives their fifth, and last, card. At this point the "bank" hands are exposed and each players hand is compared to the specific "bank" hand, or hands, that they played against, winners are determined, and wagers are settled.

Other embodiments of the present invention involve playing cards that utilize a predetermined point value where the object is to get the closest to one or more of a plurality of predetermined different point values. Other embodiments can utilize a plurality of different value combinations, such as a point total hand and a standard poker hand.

DETAILED DESCRIPTION

The present invention provides a concept that will become apparent from the ensuing descriptions, that is completely novel to the field of banking type wagering games, wherein players have the opportunity to choose from multiple different hand ranking rules within one game.

Figure 2:
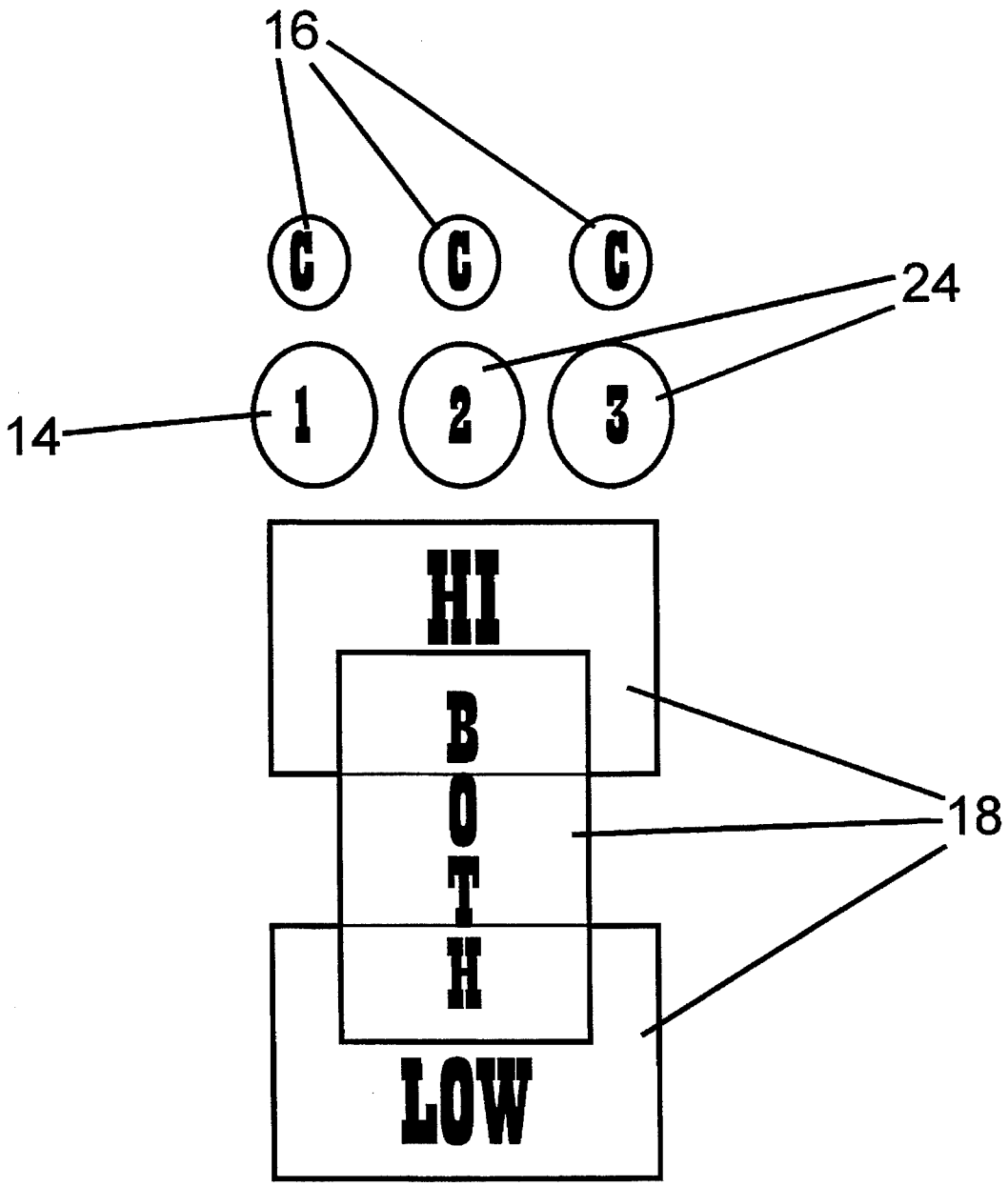
FIG. 2 is a detailed view of a player station 12 on FIG. 1.

According to one preferred embodiment of the present invention, a playing surface 10 such that is illustrated in FIG. 1 comprised of a dealer station which includes a chip tray opening 20, and a house collection slot 22. A player station 12 as illustrated in FIG. 2 is provided for each player. Each player station 12 is comprised of a wager area 14, a house collection area 16, a decision area 18, and a supplemental or "backline" wager area 24. Playing surface 10 illustrated in FIG. 1 is arranged with eight player stations 12. The actual number of player stations 12 may vary as desired by the casino.

The illustrated embodiment is designed for casinos in highly regulated jurisdictions such as within the state of California, where the casino is not permitted to participate in the game, but rather furnishes playing surface 10 and a dealer who does not play. A small percentage of the amount wagered is typically charged for providing these services. The dealer's responsibilities are to determine that all the wagers placed by the players are within the wagering limits as set by the casino, deal the cards, collect the casino's portion of each wager, declare winners and settle the wagers of the players. The dealer is also responsible for determining which player will take on the position of "bank" or banking the game, according to the rules of the casino. The "bank" typically receives a button or chip marked "bank," and the player is allowed to bank up to two consecutive rounds. The position of "bank" is then typically passed to the next player who wishes to "bank" the game.

In this illustrated embodiment, two different rules of hand ranking are implemented. The first is standard poker ranks, in descending order, Royal Flush, Straight Flush, Four of a Kind, Full House, Flush, Straight, Three of a Kind, Two Pair, One Pair, and High Card. The second is lowball poker ranks, wherein the winning hand contains the lowest cards and no pairs (two or more cards of the same value,) the best hand is Ace, 2, 3, 4, 5, the second best hand is Ace, 2, 3, 4, 6, third best hand is Ace, 2, 3, 5, 6, and so on. In the case of pairs the hand with the lowest pair (Aces are considered as the lowest card in lowball poker) is the winning hand.

The game is played with a fifty-three card deck wherein a joker is added to a standard deck of fifty-two cards, therefore limiting the game to a maximum of eight players and the "bank." A standard deck of fifty-two cards may be used without the joker, or more than one joker may be added to a standard deck of fifty-two cards as desired by the casino or by the players. A joker is typically used as an Ace, or to complete a Straight or Flush hand in standard poker. In lowball poker the joker is typically played as the lowest card Ace, 2, 3, 4, or 5 which is not one of the other four cards already in the hand.

Once the "bank" has been selected from among the players, according to the rules of the casino, and all wagers have been placed, the hand begins. The dealer will then deal a partial hand of four cards face down singly in clockwise rotation starting from the "bank," with the "bank" receiving two separate partial hands during the deal. The "bank" hands are to be kept in front of chip tray opening 20, and are not to be exposed until the completion of the deal. One of the "bank" hands will be played (Hi) using the standard poker hierarchy explained above, and the other "bank" hand will be played (Low) using the lowball poker hierarchy also explained above.

Upon examining their initial partial hand of four cards each player must decide which of the "bank" hands to play against, either the Hi hand, the Low hand, or both hands, then place their cards face down within the proper one of the three fields of decision area 18 in FIG. 2. Depending upon what is desirable to the casino, the rules can be written whereas a player must double their wager in order to play their partial hand against both "bank" hands. Once all players have set their hands in decision area 18 the dealer will announce "last card."

The dealer then deals one final card to each hand, thus completing both "bank" hands and each player hand; this completes the deal. The dealer then exposes the "bank" hands and announces the value of each separate hand, and designates which hand will play Hi, and which will play Low. When there is any question as to which hand is Hi or Low, the decision wrests completely with the "bank" player. For example, one "bank" hand is the 8, 7, 5, 3, and 2 of hearts, and the other "bank" hand is a Two Pair. The "bank" player must decide whether to play the 8, 7, 5, 3, and 2 of hearts hand as a Flush for Hi, therefore leaving the "bank" with a Two Pair for Low, or whether to play the Two Pair for Hi, therefore leaving the "bank" with an 8, 7, 5, 3, 2 for Low. Once the "bank" hands have been determined and designated Hi and Low, the dealer will then, in rotation, expose each players' five-card hand, compare it to the specific "bank" hand they decided to play against, (Hi or Low,) determine the winner and settle the wagers. Any player that decided to play against both of the "bank" hands will play half of their total wager against each specific "bank" hand.

The preferred embodiment can also employ a draw; that is to allow the player to exchange a number of cards from their five card hand, and receive the same number of cards from the deck in return. After each player has decided Hi, Low, or both and received their last card, each player will be allowed a draw in turn in an effort to improve their hand. No player will be allowed to change their decision before or after the draw. The "bank" will be given the option to draw after the "bank" hands have been designated Hi and Low.

Other embodiments of the present invention, which are suitable to be played in less regulated jurisdictions such as Las Vegas, provide a player with a plurality of predetermined different winning hand combinations, wherein there are no "bank" hands to play against. In one embodiment for example, which utilizes the same hierarchies as the preferred embodiment above, each players hand must achieve One Pair of tens or higher to win for standard poker (Hi,) or a 9, 8, 7, 6, 5, or lower to win for lowball (Low,) with certain combinations having a higher payout, e.g. a Royal Flush will have the highest payout and One Pair of tens will pay even money for a hand played Hi. Each player is dealt a partial hand and must decide which direction to play, Hi, or Low, before receiving the remainder of the hand in this embodiment a player that plays a hand both ways will receive the specified payout on each goal, Hi, or Low, for half of the total wager. For example, a player with 9, 8, 7, 6, 5, of varied suit, who decided to play the hand to both objectives (Hi and Low) will receive even money for half of their wager for a winning low combination, and will receive the predetermined payout for a Straight on the other half of their wager. However, a player with an 8, 7, 6, 5, 2, of varied suit, who decided to play the hand to both objectives (Hi and Low) would receive the predetermined payout for an "8" low on half of the wager and would lose half of the wager.

According to another embodiment, recognized card values are used where picture cards are worth ten, number cards are worth their respective numerical value, and aces are worth one or eleven at the players option. The "bank" hands in this game are played low and high with the winning low hand being the one closest to seven, and the winning high hand being the one closest to twenty-seven. In this embodiment each player is dealt three initial cards. Each player then must decide which "bank" hand to play their hand against, high, low, or both. After their decision is made, each player has the option of receiving one additional card in an effort to improve their hand. Once all players have decided high, low, or both, and have received their additional card, if desired, the "bank" hands are exposed. The "bank" hand with the lowest point total is low, and the "bank" hand with the highest point total is high. The "bank" also has the option of taking an additional card in an effort to improve these hands.

Another embodiment utilizes a combination of the above embodiments wherein the "bank" has three separate hands with the low hand played to seven, the high hand played to twenty-seven, and the third hand played best standard poker value (poker.) Upon receiving their initial partial hand, each player must decide which "bank" hand to play against; high, low, poker, or any combination of the three. In this game a player with three aces and a four as their final hand would have a very good chance of winning against all three of the "bank" hands.

CONCLUSIONS, RAMIFICATIONS, AND SCOPE

Accordingly, it is apparent that the present invention provides a method whereby a plurality of different game strategies can be utilized within a single banking type wagering game.

Although the description above contains many specificities, these should not be construed as limiting the scope of the invention but as merely providing illustrations of some of the presently preferred embodiments of this invention. For example, versions of the above described embodiments could be incorporated into electronic gaming devices, wherein the dealer would be replaced by electronic hardware and software.

Thus the scope of the invention should be determined by the appended claims and their legal equivalents, rather than by the examples given.

We claim:

1. A method of playing a card game between at least two players, with a dealer who does not play, comprising the steps of:

selecting one player to act as a bank player, a dealer dealing said bank player a plurality of independent bank hands, wherein said plurality of independent bank hands are never commingled or combined, wherein a different set of predetermined hand ranking rules is applied to each said independent bank hand, said dealer dealing a player only a single partial hand, upon viewing said single partial hand, said player making a decision regarding which of said plurality of independent bank hands that said single partial hand will play against, after said decision has been made, said dealer dealing said player a remainder of said single partial hand forming a single complete hand, a comparison being made between said single complete hand and said independent bank hand or hands that said player chose to play said single partial hand against, and upon completion of said comparison, a winning hand is determined using said predetermined set of hand ranking rules applied to said chosen independent bank hand or hands as a criteria.

2. A method of playing a card game according to claim 1 wherein said player has the option of declaring said single partial hand as said single complete hand without receiving said remainder of said single partial hand.

3. A method of playing a card game according to claim 1 further comprising the step of allowing said player an option to alter said single complete hand in an effort to improve said single complete hand based upon said sets of predetermined hand ranking rules.

4. A method of playing a card game according to claim 1 further comprising the step of allowing said bank player an option to alter said independent bank hands in an effort to improve said independent bank hands based upon said sets of predetermined hand ranking rules.

5. A method of playing a card game according to claim 1 further comprising the step of said bank player reviewing said independent bank hands and designating which of said set of predetermined hand ranking rules each of said independent bank hands will employ.

6. A method of playing a card game according to claim 5 wherein said player has the option of declaring said single partial hand as said single complete hand without receiving said remainder of said single partial hand.

7. A method of playing a card game according to claim 5 further comprising the step of allowing said player an option to alter said single complete hand in an effort to improve said single complete hand based upon said sets of predetermined hand ranking rules.

8. A method of playing a card game according to claim 5 further comprising the step of allowing said bank player an option to alter said independent bank hands in an effort to improve said independent bank hands based upon said sets of predetermined hand ranking rules.

9. A method of playing a card game between a dealer and at least one player comprising the steps of:

a dealer providing a plurality of independent bank hands, wherein said plurality of independent bank hands are never commingled or combined, wherein a different set of predetermined hand ranking rules is applied to each said independent bank hand, said dealer providing a player with only a single partial hand, upon viewing said single partial hand, said player making a decision regarding which of said plurality of independent bank hands that said single partial hand will play against, after said decision has been made, said dealer providing said player with a remainder of said single partial hand forming a single complete hand, a comparison being made between said single complete hand and said independent bank hand or hands that said player chose to play said single partial hand against, and upon completion of said comparison, a winning hand is determined using said predetermined set of hand ranking rules applied to said chosen independent bank hand or hands as a criteria.

10. A method of playing a card game according to claim 9 wherein said player has the option of declaring said single partial hand as said single complete hand without receiving said remainder of said single partial hand.

11. A method of playing a card game according to claim 9 further comprising the step of allowing said player an option to alter said single complete hand in an effort to improve said single complete hand based upon said sets of predetermined hand ranking rules.

12. A method of playing a card game according to claim 9 further comprising the step of allowing said dealer an option to alter said independent bank hands in an effort to improve said independent bank hands based upon said sets of predetermined hand ranking rules.

13. A method of playing a card game according to claim 9 further comprising the step of said dealer reviewing said independent bank hands and designating which said set of predetermined hand ranking rules each of said independent bank hands will employ.

14. A method of playing a card game according to claim 13 wherein said player has the option of declaring said single partial hand as said single complete hand without receiving said remainder of said single partial hand.

15. A method of playing a card game according to claim 13 further comprising the step of allowing said player an option to alter said single complete hand in an effort to improve said single complete hand based upon said sets of predetermined hand ranking rules.

16. A method of playing a card game according to claim 13 further comprising the step of allowing said dealer an option to alter said independent bank hands in an effort to improve said independent bank hands based upon said sets of predetermined hand ranking rules.

17. A method of playing a card game between a dealer and at least one player comprising the steps of:

providing a plurality of different hand ranking rules, with each said plurality of different hand ranking rules calling for a predetermined minimum winning hand rank, a player placing a wager, a dealer dealing said player only a single partial hand, with no cards dealt to said dealer, upon viewing said single partial hand, said player chooses one or more of said plurality of different hand ranking rules to apply to said single partial hand, said dealer dealing said player a remainder of said single partial hand, forming a single complete hand, said single complete hand being compared to only said predetermined minimum winning hand rank of said chosen hand ranking rules, and said dealer paying said player a predetermined amount based upon said wager if said single complete hand achieves at least said predetermined minimum winning hand rank,said dealer collecting said player's wager if said complete hand does not achieve at least said predetermined minimum winning hand rank.

18. A method of playing a card game according to claim 17 wherein said player has the option of declaring said single partial hand as said single complete hand without receiving said remainder of said single partial hand.

19. A method of playing a card game according to claim 17 further comprising the step of allowing said player an option to alter said single complete hand in an effort to improve said single complete hand based upon said different hand ranking rules.

* * * * *